US010336531B2

(12) United States Patent
Trombetta et al.

(10) Patent No.: US 10,336,531 B2
(45) Date of Patent: Jul. 2, 2019

(54) CAPSULE WITH STEEPING CHAMBER

(71) Applicant: 2266170 Ontario Inc., Mississauga (CA)

(72) Inventors: Liberatore A. Trombetta, Ancaster (CA); Yucheng Fu, Mississauga (CA); Shelby Parkinson, Paris (CA)

(73) Assignee: 2266170 Ontario Inc., Mississauga, ON (CA)

( * ) Notice: Subject to any disclaimer, the term of this patent is extended or adjusted under 35 U.S.C. 154(b) by 262 days.

(21) Appl. No.: 15/127,528

(22) PCT Filed: Mar. 20, 2015

(86) PCT No.: PCT/CA2015/050214

§ 371 (c)(1),
(2) Date: Sep. 20, 2016

(87) PCT Pub. No.: WO2015/139140

PCT Pub. Date: Sep. 24, 2015

(65) Prior Publication Data

US 2018/0118450 A1 May 3, 2018

Related U.S. Application Data

(60) Provisional application No. 61/968,843, filed on Mar. 21, 2014.

(51) Int. Cl.
*B65D 85/804* (2006.01)

(52) U.S. Cl.
CPC ..... *B65D 85/8043* (2013.01); *B65D 85/8046* (2013.01)

(58) Field of Classification Search
CPC ..... B65D 85/8043
See application file for complete search history.

(56) References Cited

U.S. PATENT DOCUMENTS 2,113,715 A 4/1938 Wilcox
2,987,221 A 6/1961 Milton
(Continued)

FOREIGN PATENT DOCUMENTS

CA 2012891 9/1991
CA 2276927 1/2000
(Continued)

OTHER PUBLICATIONS

Kalpakjian, Schmid, Polymer Properties, Table 10.1, Manfacturing Processes for Engineering Materials 5th ed., Pearson Education 2008, [on line]. Downloaded from the Internet: URL:<https://www.slideshare.net/abhalim77/ch10-53447436>.*
(Continued)

*Primary Examiner* — Viren A Thakur
*Assistant Examiner* — Chaim A Smith
(74) *Attorney, Agent, or Firm* — Manelli Selter PLLC; Edward J. Stemberger

(57) ABSTRACT

A capsule is provided for use in a machine for preparing a consumable product from capsules. The capsule includes a body that defines an interior space with an opening. A cover is disposed over the opening and is adapted to shrink sufficiently when pierced by the injection system to allow pressure to build beneath the cover up to a maximum pressure. A filter is disposed in the interior space to define a steeping chamber between the filter and the cover and is adapted to restrict the flow of fluid sufficiently to cause the steeping chamber to fill with fluid without exceeding the maximum pressure. Ingredients are disposed in the interior space for preparing a desired product.

16 Claims, 5 Drawing Sheets

(56) References Cited

U.S. PATENT DOCUMENTS 3,110,121 A 11/1963 Corrinet
3,282,703 A 11/1966 Broadhurst
3,399,806 A 9/1968 Lucas
3,713,936 A 1/1973 Ramsay
4,101,627 A 7/1978 Menier
4,131,064 A 12/1978 Ryan et al.
4,220,673 A 9/1980 Strobel
4,235,160 A 11/1980 Olney et al.
4,306,367 A 12/1981 Otto
4,440,796 A 4/1984 Lunder et al.
4,471,689 A 9/1984 Piana
4,518,639 A 5/1985 Phillips
4,559,729 A 12/1985 White
4,619,830 A 10/1986 Napier
4,701,365 A 10/1987 Iwaski
4,728,425 A 3/1988 Sandvig
4,859,337 A 8/1989 Woltermann
4,865,737 A 9/1989 McMichael
4,867,993 A 9/1989 Nordskog
4,981,588 A 1/1991 Poulallion
4,983,410 A * 1/1991 Dinos ..... B65D 85/8043 426/110
4,995,310 A 2/1991 van der Lijn et al.
4,996,066 A 2/1991 Love et al.
5,008,013 A 4/1991 Favre et al.
5,076,433 A 12/1991 Howes
5,298,267 A 3/1994 Gruenbacher
5,331,793 A 7/1994 Pophal et al.
5,390,587 A 2/1995 Wu
5,447,631 A 9/1995 Mahlich
5,456,929 A 10/1995 Mifune et al.
5,496,573 A 3/1996 Tsuji et al.
5,536,290 A 7/1996 Stark et al.
5,575,383 A 11/1996 Seeley
5,601,716 A 2/1997 Heinrich et al.
5,605,710 A 2/1997 Prindonoff et al.
5,633,026 A * 5/1997 Gruenbacher ..... A47J 31/0615 426/435
5,738,786 A 4/1998 Winnington-Ingram
5,806,582 A 9/1998 Howes
5,840,189 A 11/1998 Sylvan et al.
5,858,437 A 1/1999 Anson
5,866,185 A 2/1999 Burkett
5,871,096 A 2/1999 Yakich
5,871,644 A 2/1999 Simon et al.
5,882,716 A 3/1999 Munz-Schaerer et al.
5,885,314 A 3/1999 Oussoren et al.
5,895,672 A 4/1999 Cooper
5,896,686 A 4/1999 Howes
5,897,899 A 4/1999 Fond
5,923,242 A 7/1999 Slagle et al.
5,957,279 A 9/1999 Howes
5,971,195 A 10/1999 Reidinger et al.
6,025,000 A 2/2000 Fond et al.
6,146,270 A 11/2000 Huard et al.
6,189,438 B1 2/2001 Bielfeldt et al.
6,220,147 B1 4/2001 Priley
6,223,937 B1 5/2001 Schmidt
6,440,256 B1 8/2002 Gordon et al.
6,514,555 B1 2/2003 Fayard et al.
6,548,433 B1 4/2003 Gbur et al.
6,557,597 B2 5/2003 Riesterer
6,561,232 B1 5/2003 Frutin
6,589,577 B2 7/2003 Lazaris et al.
6,607,762 B2 8/2003 Lazaris et al.
6,622,615 B2 9/2003 Heczko
6,644,173 B2 11/2003 Lazaris et al.
6,645,537 B2 11/2003 Sweeney et al.
6,658,989 B2 12/2003 Sweeney et al.
6,720,070 B2 4/2004 Hamaguchi et al.
6,758,130 B2 7/2004 Sargent et al.
6,810,788 B2 11/2004 Hale
6,841,185 B2 1/2005 Sargent et al.
6,854,378 B2 2/2005 Jarisch et al.
6,869,627 B2 3/2005 Perkovic et al.
6,913,777 B2 7/2005 Rebhorn et al.
6,959,832 B1 11/2005 Sawada
6,992,586 B2 1/2006 Rosenfeld
7,067,038 B2 6/2006 Trokhan et al.
7,153,530 B2 12/2006 Masek et al.
7,279,188 B2 10/2007 Arrick et al.
7,311,209 B2 12/2007 Bentz et al.
7,328,651 B2 2/2008 Halliday et al.
7,387,063 B2 6/2008 Vu et al.
7,412,921 B2 8/2008 Hu et al.
7,490,542 B2 2/2009 Macchi et al.
7,543,527 B2 6/2009 Schmed
7,552,672 B2 6/2009 Schmed
7,552,673 B2 6/2009 Levin
7,624,673 B2 6/2009 Zanetti
7,594,470 B2 9/2009 Scarchilli et al.
7,640,842 B2 1/2010 Bardazzi
7,681,492 B2 3/2010 Suggi et al.
7,685,930 B2 3/2010 Mandralis et al.
7,763,300 B2 7/2010 Sargent et al.
7,798,055 B2 9/2010 Mandralis et al.
7,854,192 B2 12/2010 Denisart et al.
7,856,920 B2 12/2010 Schmed et al.
7,856,921 B2 12/2010 Arrick et al.
7,910,145 B2 3/2011 Reati
8,062,682 B2 11/2011 Mandralis et al.
8,225,771 B2 7/2012 Andre
8,286,547 B1 10/2012 Lassota
8,361,527 B2 1/2013 Winkler et al.
8,409,646 B2 4/2013 Yoakim et al.
8,425,957 B2 4/2013 Steenhof
8,474,368 B2 7/2013 Kilber et al.
8,475,854 B2 7/2013 Skalski et al.
8,481,097 B2 7/2013 Skalski et al.
8,573,114 B2 11/2013 Huang et al.
8,591,978 B2 11/2013 Skalski et al.
8,673,379 B2 3/2014 Skalski et al.
8,740,020 B2 6/2014 Marina et al.
8,834,948 B2 9/2014 Estabrook et al.
2002/0020659 A1 2/2002 Sweeney et al.
2003/0005826 A1 1/2003 Sargent et al.
2003/0039731 A1 2/2003 Dalton et al.
2003/0082360 A1 5/2003 O'Donnell et al.
2003/0087005 A1 5/2003 Baron
2004/0045443 A1 * 3/2004 Lazaris ..... B65D 85/8043 99/279
2005/0016383 A1 1/2005 Kirschner et al.
2005/0051478 A1 3/2005 Karanikos et al.
2005/0287251 A1 12/2005 Lazaris et al.
2006/0057373 A1 3/2006 Inagaki et al.
2006/0236871 A1 10/2006 Ternite et al.
2006/0246187 A1 11/2006 Egolf et al.
2007/0144356 A1 6/2007 Rivera
2007/0148290 A1 6/2007 Ternite
2007/0275125 A1 11/2007 Catani
2008/0015098 A1 1/2008 Littlejohn et al.
2008/0142115 A1 6/2008 Vogt et al.
2008/0156196 A1 7/2008 Doglioni et al.
2008/0202075 A1 8/2008 Kronawittleithner et al.
2008/0245236 A1 10/2008 Ternite et al.
2009/0110775 A1 4/2009 Rijskamp et al.
2009/0133584 A1 5/2009 De Graaff et al.
2009/0165228 A1 7/2009 Kilkenny
2009/0175986 A1 7/2009 Doglioni Majer
2009/0186141 A1 7/2009 Almblad et al.
2009/0206084 A1 8/2009 Woolf et al.
2009/0211458 A1 8/2009 Denisart et al.
2009/0260690 A1 10/2009 Bell
2009/0311389 A1 12/2009 Zoss et al.
2009/0324791 A1 12/2009 Ohresser et al.
2010/0003379 A1 1/2010 Zoss et al.
2010/0028495 A1 2/2010 Novak et al.
2010/0116772 A1 5/2010 Teys
2010/0215808 A1 8/2010 Versini
2010/0239733 A1 9/2010 Yoakim et al.
2010/0303964 A1 12/2010 Beaulieu et al.
2011/0003040 A1 1/2011 Graf et al.
2011/0033580 A1 2/2011 Bieshuevel et al.
2011/0045144 A1 2/2011 Boussemart et al.

(56) References Cited

U.S. PATENT DOCUMENTS

| | | | |
|---|---|---|---|
| 2011/0076361 | A1 | 3/2011 | Peterson et al. |
| 2011/0183048 | A1 | 7/2011 | Noble et al. |
| 2011/0185911 | A1 | 8/2011 | Rapparini |
| 2011/0247975 | A1 | 10/2011 | Rapparini |
| 2012/0006205 | A1 | 1/2012 | Vanni |
| 2012/0024160 | A1 | 2/2012 | Van et al. |
| 2012/0052163 | A1 | 3/2012 | Doleac et al. |
| 2012/0058226 | A1 | 3/2012 | Winkler et al. |
| 2012/0070542 | A1 | 3/2012 | Camera et al. |
| 2012/0070551 | A1 | 3/2012 | Mahlich |
| 2012/0097602 | A1 | 4/2012 | Tedford |
| 2012/0121764 | A1 | 5/2012 | Lai et al. |
| 2012/0171334 | A1 | 7/2012 | Yoakim |
| 2012/0174794 | A1 | 7/2012 | Fraij |
| 2012/0180670 | A1 | 7/2012 | Yoakim |
| 2012/0180671 | A1 | 7/2012 | Baudet |
| 2012/0183649 | A1 | 7/2012 | Burkhalter |
| 2012/0186457 | A1 | 7/2012 | Ozanne |
| 2012/0196008 | A1 | 8/2012 | York |
| 2012/0199007 | A1 | 8/2012 | Larzul |
| 2012/0199010 | A1 | 8/2012 | Mariller |
| 2012/0199011 | A1 | 8/2012 | Cheng |
| 2012/0201933 | A1 | 8/2012 | Dran et al. |
| 2012/0207893 | A1 | 8/2012 | Kreuger |
| 2012/0207894 | A1 | 8/2012 | Webster |
| 2012/0210876 | A1 | 8/2012 | Glucksman |
| 2012/0210878 | A1 | 8/2012 | Mariller |
| 2012/0210879 | A1 | 8/2012 | Mariller |
| 2012/0231123 | A1 | 9/2012 | Kamerbeek |
| 2012/0231124 | A1 | 9/2012 | Kamerbeek |
| 2012/0231126 | A1 | 9/2012 | Lo Faro |
| 2012/0231133 | A1 | 9/2012 | Kamerbeek |
| 2012/0251668 | A1 | 10/2012 | Wong |
| 2012/0251669 | A1 | 10/2012 | Kamerbeek |
| 2012/0251670 | A1 | 10/2012 | Kamerbeek |
| 2012/0251671 | A1 | 10/2012 | Kamerbeek |
| 2012/0251692 | A1 | 10/2012 | Kamerbeek |
| 2012/0251693 | A1 | 10/2012 | Kamerbeek |
| 2012/0251694 | A1 | 10/2012 | Kamerbeek |
| 2012/0258204 | A1 | 10/2012 | Tsuji |
| 2012/0258210 | A1 | 10/2012 | Wong |
| 2012/0258219 | A1 | 10/2012 | Wong |
| 2012/0258221 | A1 | 10/2012 | Wong |
| 2012/0260806 | A1 | 10/2012 | Rolfes |
| 2012/0263829 | A1 | 10/2012 | Kamerbeek |
| 2012/0263830 | A1 | 10/2012 | Kamerbeek |
| 2012/0263833 | A1 | 10/2012 | Wong |
| 2012/0266755 | A1 | 10/2012 | Baudet |
| 2012/0269933 | A1 | 10/2012 | Rapparini |
| 2012/0272830 | A1 | 11/2012 | Gugerli |
| 2012/0276252 | A1 | 11/2012 | Bunke |
| 2012/0276255 | A1 | 11/2012 | Verbeek |
| 2012/0297987 | A1 | 11/2012 | Lee |
| 2012/0301581 | A1 | 11/2012 | Abegglen |
| 2012/0307024 | A1 | 12/2012 | Howes |
| 2012/0308688 | A1 | 12/2012 | Peterson |
| 2012/0312174 | A1 | 12/2012 | Lambert |
| 2012/0321755 | A1 | 12/2012 | Macaulay |
| 2012/0321756 | A1 | 12/2012 | Estabrook et al. |
| 2012/0328739 | A1 | 12/2012 | Nocera |
| 2012/0328740 | A1 | 12/2012 | Nocera |
| 2012/0328744 | A1 | 12/2012 | Nocera |
| 2013/0004629 | A1 | 1/2013 | Clark |
| 2013/0004637 | A1 | 1/2013 | Gugerli |
| 2013/0008316 | A1 | 1/2013 | Hoeglauer |
| 2013/0011521 | A1 | 1/2013 | Weijers et al. |
| 2013/0017303 | A1 | 1/2013 | Vu |
| 2013/0025466 | A1 | 1/2013 | Fu |
| 2013/0032034 | A1 | 2/2013 | Jarisch |
| 2013/0047863 | A1 | 2/2013 | Larzul |
| 2013/0059039 | A1 | 3/2013 | Trombetta |
| 2013/0059903 | A1 | 3/2013 | Deuber |
| 2013/0068109 | A1 | 3/2013 | Pribus et al. |
| 2013/0084368 | A1 | 4/2013 | Linck et al. |
| 2013/0095219 | A1 | 4/2013 | de Graaff et al. |
| 2013/0115342 | A1 | 5/2013 | Van et al. |
| 2013/0122153 | A1 | 5/2013 | Ferrier et al. |
| 2013/0122167 | A1 | 5/2013 | Winkler et al. |
| 2013/0142931 | A1 | 6/2013 | Fin et al. |
| 2013/0156899 | A1* | 6/2013 | Quinn ..... A47J 31/407 426/115 |
| 2013/0259982 | A1 | 10/2013 | Abegglen et al. |
| 2013/0340626 | A1 | 12/2013 | Oh |
| 2013/0344205 | A1 | 12/2013 | Oh |
| 2014/0013958 | A1 | 1/2014 | Krasne et al. |
| 2014/0037802 | A1 | 2/2014 | Cardoso |
| 2014/0099388 | A1 | 4/2014 | Wang et al. |
| 2014/0124435 | A1 | 5/2014 | Jackson |
| 2014/0220192 | A1* | 8/2014 | Deeb ..... A47J 31/407 426/115 |
| 2015/0050391 | A1 | 2/2015 | Rapparini |

FOREIGN PATENT DOCUMENTS

| | | | |
|---|---|---|---|
| CA | 2516417 | A1 | 9/2004 |
| CA | 2517840 | | 11/2004 |
| CA | 2689804 | A1 | 3/2008 |
| CA | 2686347 | A1 | 12/2008 |
| CA | 2745239 | | 6/2010 |
| CA | 2807489 | | 2/2012 |
| CA | 2824199 | A1 | 8/2012 |
| CA | 2831304 | | 10/2012 |
| CA | 2759782 | A1 | 11/2012 |
| CA | 2839293 | | 12/2012 |
| CA | 2810236 | A1 | 3/2013 |
| EP | 0047169 | A2 | 3/1982 |
| EP | 0145499 | | 6/1985 |
| EP | 0432126 | A1 | 6/1991 |
| EP | 0 615 921 | * | 9/1994 |
| EP | 1208782 | | 8/2004 |
| EP | 1593329 | | 11/2005 |
| EP | 1859683 | | 11/2007 |
| EP | 2230195 | | 9/2010 |
| EP | 2345351 | | 7/2011 |
| EP | 2409608 | | 1/2012 |
| FR | 2930522 | A1 | 10/2009 |
| GB | 803486 | A | 10/1958 |
| GB | 962038 | | 6/1964 |
| GB | 2074838 | | 11/1981 |
| JP | 662737 | | 3/1994 |
| JP | 11171249 | A | 6/1999 |
| WO | 9212660 | | 8/1992 |
| WO | 0145616 | A1 | 6/2001 |
| WO | 03082065 | A1 | 10/2003 |
| WO | 2004083071 | A1 | 9/2004 |
| WO | 2004112556 | | 12/2004 |
| WO | 2009114119 | | 9/2009 |
| WO | 2010013146 | A2 | 2/2010 |
| WO | 2010066705 | | 6/2010 |
| WO | 2010085824 | | 8/2010 |
| WO | 2011095518 | | 8/2010 |
| WO | 201006516 | A1 | 9/2010 |
| WO | 2010137956 | A1 | 12/2010 |
| WO | 2012031106 | A1 | 3/2012 |
| WO | 2012069505 | | 5/2012 |
| WO | 2014037339 | | 3/2014 |
| WO | 2014056862 | | 4/2014 |

OTHER PUBLICATIONS

International Search Report in PCT/CA2015/050214 dated Jun. 17, 2015.

* cited by examiner

CAPSULE WITH STEEPING CHAMBER

FIELD

This specification relates to capsules for preparing consumable products using capsule machines, and in particular to capsules adapted to provide improved conditions for preparing a steeped consumable product in a capsule machine.

BACKGROUND

The following background discussion is not an admission that anything discussed below is citable as prior art or common general knowledge. The documents listed below are incorporated herein in their entirety by this reference to them.

Single serve capsules adapted for use in machines to prepare a desired consumable product are becoming increasingly popular. Such capsules come in a variety of formats for producing consumable products such as coffee, tea or hot chocolate.

In North America, a leading provider of capsules and capsule machines is Keurig Green Mountain Inc. This company produces K-Cup™ capsules and Keurig™ capsule machines also known as brewers). K-Cup™ capsules have a first chamber defined by a paper filter that is loosely packed with ingredients (such as ground coffee) and a second chamber downstream of the first chamber that defines an empty space for receiving a prepared product that flows through the paper filter prior to dispensing into a cup.

A predetermined volume of heated water is injected by a Keurig™ machine into the first chamber of a K-cup™ coffee capsule at a predetermined flow rate. The heated water flows through the ingredients in the capsule and contacts the paper filter. The bottom portion of the paper filter quickly becomes saturated and allows the prepared product to flow through the filter at substantially the same flow rate as fluid enters the capsule. As a result, the fluid tends to continuously flow through the ingredients with less than optimum mixing and extraction. It has been found that ingredients in K-cup™ capsules used in Keurig™ machines are not optimally saturated other than ingredients disposed along the central fluid flow path of the capsule. Nonetheless, K-cup™ capsules remain a leading brand of capsules in the North American single serve coffee market.

The optimum conditions for preparing drip-style coffee differ from the optimum conditions for preparing other forms of consumable products. For example, certain consumable products, such as whole leaf tea products, benefit from soaking or steeping (the term steeping will be used hereafter) the precursor ingredients in a fluid, such as heated water, for a desired period of time prior to dispensing into a user's cup. Such products often also benefit from a mixing or turbulence of the precursor ingredients within the fluid during the steeping phase.

A problem with conventional capsules and capsule machines such as the K-cup™ capsules and Keurig™ machines is that their structure and operations are designed primarily for the purpose of preparing drip-style filtered coffee. This problem is exasperated by the desire to produce a prepared beverage in a relatively short time frame (60 seconds or less) thus requiring fluid to be injected into the machine at a relatively high flow rate.

This problem could be addressed by designing capsule machines that provide optimum conditions for preparing a steeped consumable product. This does not provide a solution for consumers who desire a shorter preparation time or who already own a conventional capsule machine and wish to avoid acquiring a new appliance however.

There is a need for a capsule that is adapted to provide improved conditions for preparing a steeped consumable product. There is also a need for such a capsule to be used with conventional capsule machines.

SUMMARY

In one aspect the invention provides a capsule, for use in a machine for preparing consumable products from capsules, said machine having an injection system that includes at least one injection nozzle for injecting heated fluid into said capsule at a predetermined flow rate, said capsule comprising:

a body defining an interior space with an opening;

a cover disposed over said opening, said cover being formed of a material that is resistant to tearing and adapted to shrink sufficiently around said at least one injection nozzle when said at least one injection nozzle pierces said cover and injects heated fluid into said capsule to create a seal that allows pressure to build within said interior space beneath said cover up to a maximum pressure;

a filter disposed in said interior space to define a steeping chamber between said filter and said cover, said filter being formed of one or more materials that are sufficiently phobic to said heated fluid to cause said steeping chamber to fill with fluid without exceeding said maximum pressure; and ingredients disposed in said interior space for preparing a desired product.

In another aspect, the invention provides a capsule, for use in a machine for preparing consumable products from capsules, said capsule comprising:

a body defining an interior space with an opening;

a cover disposed over said opening;

a filter disposed in said interior space to define a chamber between said filter and said cover; and ingredients disposed in said chamber for preparing a desired product, at least 50% of said ingredients having a particulate size greater than a #16 mesh.

Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Figure 1:
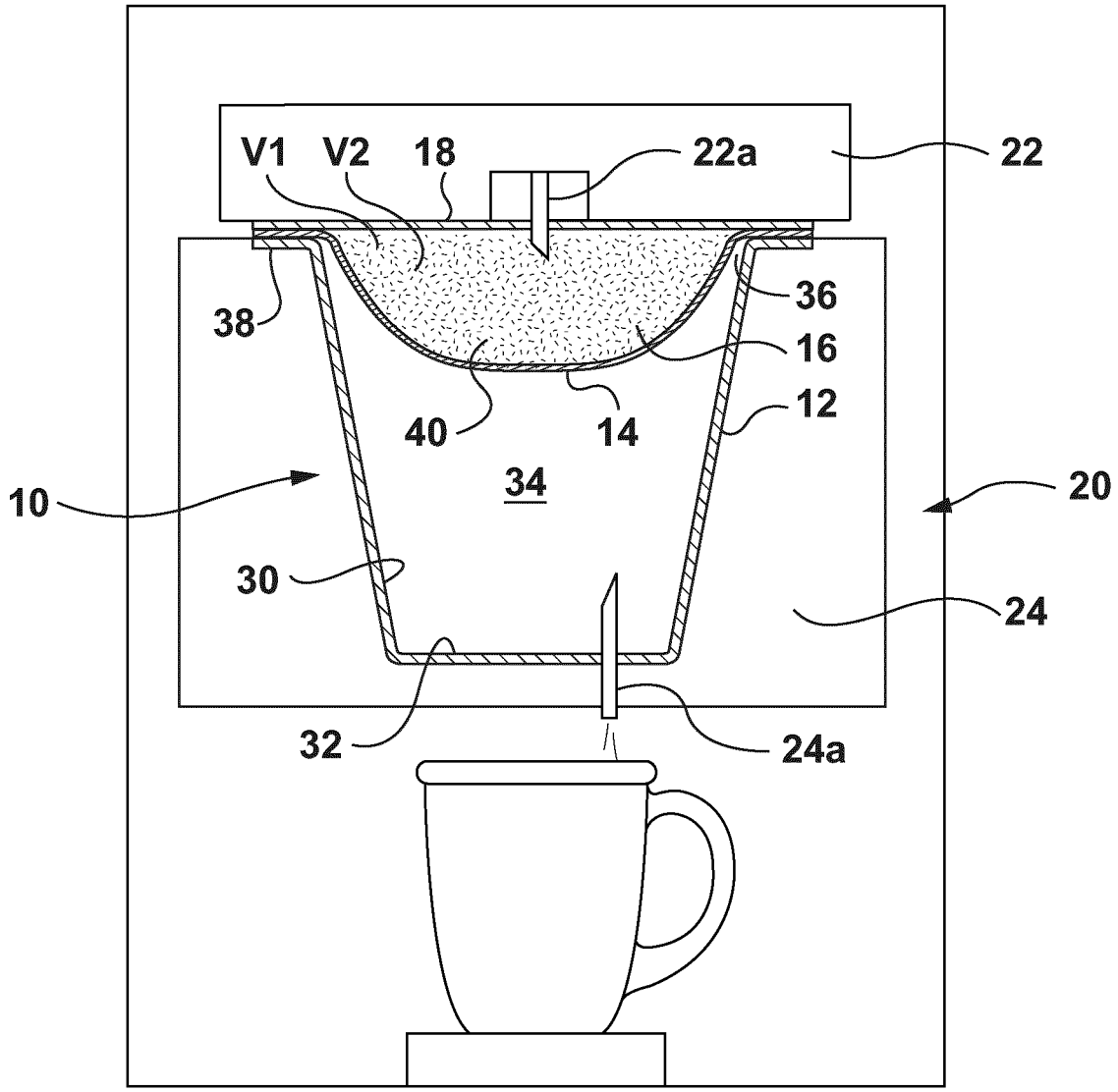
FIG. 1 is a sectional view of a capsule in accordance with one aspect of the present invention disposed within a schematic representation of a machine for preparing consumable products from capsules.

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

A capsule in accordance with the present invention is shown generally at 10 in the Figures. Capsule 10 includes a body 12, filter 14, ingredients 16 and cover 18. Body 12 and cover 18 are each preferably formed of multilayered materials that include one or more barrier layers providing barriers against one or more environmental factors such as light, oxygen, and moisture. Capsule 10 may be sized to provide a single serving of a desired product or multiple servings.

Capsule 10 is sized and configured for use in a machine 20 that is adapted for preparing a product from capsule 10.

Machine 20 includes an injection system 22 for injecting a fluid, typically heated water, into the capsule 10 for mixing with ingredients 16. Injection system 22 may include at least one injection nozzle 22*a* disposed on machine 20 that is adapted to pierce cover 18 to inject fluid into capsule 10. In an alternative embodiment (not shown), injection system 22 may have at least one component disposed on capsule 10, such as on body 12 beneath cover 18, and adapted to pierce cover 18 and interact with other components of injection system 22 on machine 20 to inject fluid into capsule 10.

Machine also includes a dispensing system 24 for dispensing product from capsule 10 into a desired receptacle such as a bowl or cup. Dispensing system 24 may include a hollow probe 24*a* that is adapted to pierce capsule 10 to dispense a prepared product from capsule 10.

Body 12 of capsule 10 includes a sidewall 30 and an end wall 32 together defining an interior space 34. Interior space 34 preferably has a volume in the range of 30 cc to 100 cc for preparing a single serving of beverage and more preferably a volume in the range of 40 cc to 80 cc.

An opening 36 is defined at one end of body 12 and a flange 38 extends around the perimeter of opening 36 to receive cover 18 and to support capsule 10 within machine 20. Filter 14 may be secured to flange 38 or to an interior surface of capsule 10 (such as to sidewall 30 or the underside of cover 18).

In another embodiment (not shown), body 12 may be formed with no end wall 32 and no sidewall 30 or a partial sidewall 30. Flange 38 may still extend around the perimeter of opening 36 to receive cover 18 and to support capsule 10 within machine 20. Filter 14 may be secured to flange 38 or to partial sidewall 30 or underside of cover 18.

Cover 18 is disposed over opening 36 and secured to body 12 such as by sealing cover 18 directly to flange 38 or by sealing cover 18 to filter 14 which in turn is sealed to flange 38. Cover 18 may be transparent in order that ingredients 16 may be viewed through cover 18 prior to use of capsule 10 in machine 20.

Cover 18 is formed of a material that is resistant to tearing and adapted to shrink upon exposure to heat. Cover 18 is thus adapted to shrink around the opening formed in cover 18 by injection system 22 to form a sufficient seal to withstand the buildup in pressure within capsule 10 under normal conditions during use in machine 20. In other words, cover 18 is adapted to shrink sufficiently around the at least one injection nozzle when the at least one injection nozzle pierces the cover and injects heated fluid into the capsule to create a seal and allow the buildup in pressure within capsule up to a maximum pressure.

Preferably, cover 18 is formed of a multi-layered material having a minimum tensile strength of 3000 psi and a minimum elongation of 50%. Preferably cover 18 includes polymer materials, more preferably cover 18 comprises at least 50% polymer materials and most preferably cover 18 comprises at least 75% polymer materials.

Examples of suitable materials for cover 18 include polyethylene (PE), polyethylene terephthalate (PET) and polyamide PA6. A multi-layered material for cover 18 may include at least one layer formed of a continuous film of tear resistant and heat shrinkable material (laminated or extrusion coated) or a non-continuous film such as a non-woven polymer, mesh or perforated film. Examples of a multi-layered material for cover 18 include (from outside layer to inside layer): PET/aluminum foil/PE, PET/EVOH/PE, PET/metalized PET/PE or PET/PE. It has been found that formation of cover 18 from a multilayered PET/PE or PET/EVOH/PE material comprising at least 90% polymer materials provides preferred sealing performance around injection system 22.

A steeping chamber 40 is defined within interior space 34 of capsule 10 between cover 18 and filter 14. Steeping chamber 40 has a volume V1 that is adapted to contain a sufficient volume V2 of ingredients 16 to produce a desired consumable product using machine 20. Ingredients 16 that are disposed in steeping chamber 40, as described further below, are preferably selected for optimum extraction under the conditions within steeping chamber 40 during use of machine 20.

Figure 2:
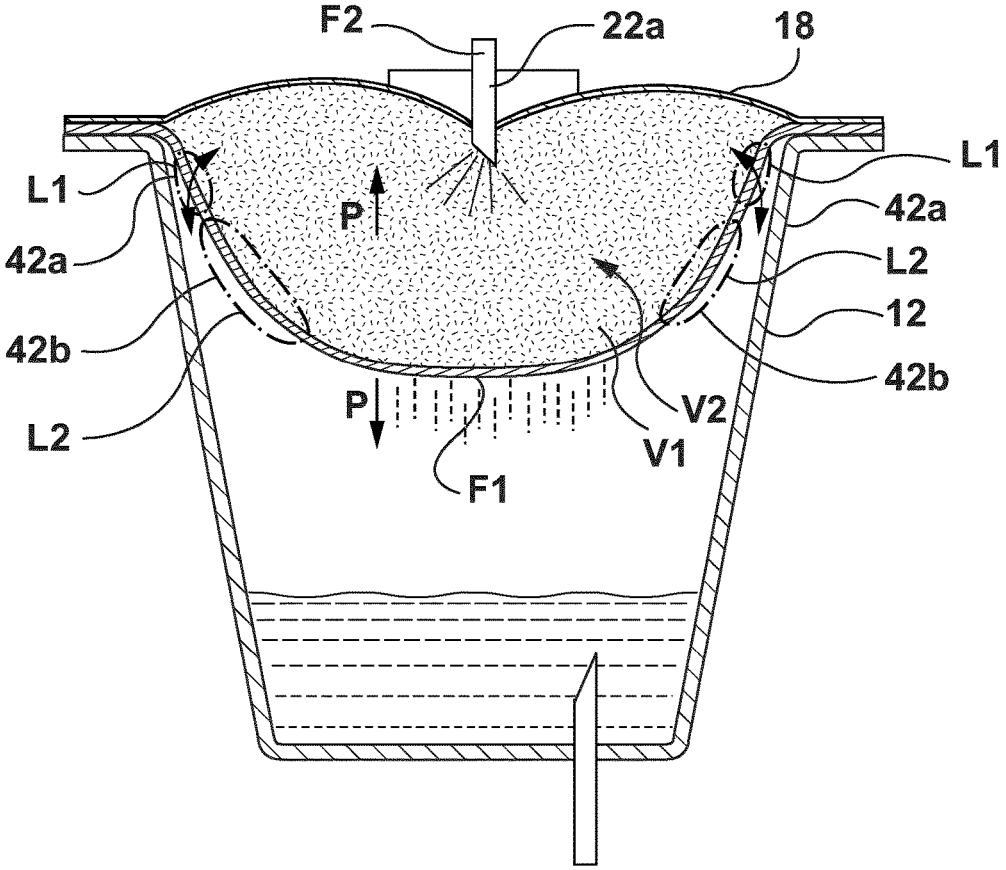
FIG. 2 is an enlarged sectional view of the capsule of FIG. 1 during use in the capsule machine.

For the embodiment depicted in FIGS. 1 and 2, the volume V2 of ingredients 16 is no less than 50% of the volume V1 of steeping chamber 40, more preferably no less than 70% and most preferably no less than 90% so that ingredients are easily visible through a transparent cover 18.

Filter 14 has an average fluid flow rate F1 that is less than the average fluid flow rate F2 of injection system 22. Preferably, the average fluid flow rate F1 of filter 14 is between 50% and 90% of the average fluid flow rate F2 of injection system 22, more preferably between 55% and 80% and most preferably between 60% and 75%.

The average fluid flow rates F1 and F2 noted above are determined over the course of the product preparation process using machine 20 in accordance with the test procedure below. An empty capsule 10 containing no filter 14 and no ingredients 16 is disposed in machine 20 and machine 20 is activated to prepare a product of a selected size. The weight of the product prepared by the machine 20 is measured as well as the time required to prepare the product from the moment machine 20 is activated to the moment the flow of prepared product has stopped. The measured weight per unit of time is deemed to be the fluid flow rate F2 for injection system 22. The first capsule is removed and an empty capsule 10 with a filter 14 (but no ingredients 16) is then disposed in same machine 20 and machine 20 is activated to prepare a product of the same selected size. The weight of the product prepared by machine 20 is measured as well as the time required to prepare the product from the moment machine 20 is activated to the moment the flow of prepared product has stopped. The measured weight per unit of time is deemed to be the fluid flow rate F1 for filter 14.

Filter 14 may have a uniform fluid flow rate F1 over its entire surface area within interior space 34 or it may be adapted to provide zones 42 having different rates of fluid flow. Filter 14 may thus be adapted to provide one or more high flow zones 42*a* that allow a relatively higher rate of fluid flow as compared to the remainder of filter 14. Conversely, filter 14 may be adapted to provide one or more low flow zones 42*b* that allow a relatively low rate of fluid flow as compared to the remainder of filter 14. Zones 42 may also be disposed at desired locations L on filter 14 to optimize the performance of steeping chamber 40. For example, high flow zones 42*a* may be at locations L1 on filter 14 proximate to cover 18 to allow air to flow in the head space above the fluid to balance the pressure differential between steeping chamber 40 and the remainder of capsule 10. Low flow zones 42*b* may be at locations L2 along the sides of filter 14 to reduce the fluid flow along such side portions and thus encourage flow through the bottom portion of filter 14.

Filter 14 is also adapted to be phobic to the fluid being injected into capsule 10. In most instances, the fluid will comprise water (either heated or cooled) and a hydrophobic filter 14 is desired. Filter 14 may be formed of materials that are phobic to fluid such as polyolefins (eg, polyethylene, polypropylene) and mixtures of polyolefins with other polymers or filter 14 may be coated with materials that are phobic to fluid such as a polyethylene coating.

Filter 14 preferably has an air permeability of at least 400 L/s.m2, more preferably at least 1000 L/s.m2 and even more preferably at least 1800 L/s.m2 (all measurements based on ASTM Standard D737-96 "Standard Test Method for Air Permeability of Textile Fabrics"). By comparison, the conventional pleated paper filter for the Keurig K-cup™ capsule has a basis weight of 40 grams per square meter (gsm) and an air permeability of approximately 250 L/s. m2.

Preferably, filter 14 is formed of a non-woven fabric filtration material such as polyester, polyethylene or nylon non-woven fabric. The basis weight for filter 14 is in the range of 40 to 150 gsm and more preferably between 70 to 120 gsm.

Preferably, filter 14 is formed of a moldable non-woven filtration material that includes a plurality of multi-component fibers that are bound or interlocked by non-woven manufacturing techniques (such as spun bond techniques) to form a web having channels extending from one side of filter 14 to the other. The desired diameter for channels after forming is between 20 and 100 μm, more preferably between 40 to 80 μm. More details of a preferred filtration material for filter 14 are provided in co-pending patent application Ser. No. 14/074,024 which is incorporated in its entirety herein by reference.

Filter 14 may alternatively be formed of a polymer sheet, such as polyester or Nylon, which may be perforated or otherwise modified to define channels. The size and distribution of openings are optimized in a way that is resistant to water exiting.

Filter 14 may alternatively be formed from an ultra high molecular weight polyethylene (UHWMPE) which is also a filter material due to the cavities/pores formed during polymerization.

Filter 14 may alternatively be formed from modified filter paper with a phobic coating to achieve the fluid resistant property. Preferably, the coating is distributed on filter in a manner that creates high flow zones and/or low flow zones as described further below.

More details of the manner for securing filter 14 and cover 18 to flange 38 of body 12 are provided in co-pending patent application Ser. No. 13/600,582 which is incorporated in its entirety herein by reference.

Cover 18 and filter 14 may be adapted to be removed from body 12 for instance by separating an integral tab (not shown) defined in flange 38 and applying a peeling force. More details of capsules 10 having portions that are removable are provided in co-pending patent application Ser. No. 14/098,915 which is incorporated in its entirety herein by reference.

While filter 14 has an average fluid flow rate F1 over the course of the product preparation process in machine 20, the fluid flow rate may vary widely at different times during the process due to the fluid phobic properties of filter 14. At the beginning of the product preparation process for example, as steeping chamber 40 is filling with fluid, the phobic properties of filter 14 may result in little or no fluid flowing through filter 14. This results in an extended dwell time for ingredients 16 and fluid within steeping chamber 40. Once steeping chamber 40 is filled with fluid then the fluid flow rate of filter 14 may increase as fluid continues to flow into steeping chamber 40 through injection system 22 and as the surface tension of fluid is broken and fluid is forced to flow through filter 14. Certain machines 20 may further include a pulse cycle that varies the timing and/or amount of fluid that is injected into the capsule 10 using injection system 22.

The phobic properties of filter 14 are adapted to restrict the flow of fluid through capsule 10 by a sufficient amount within the operational constraints of machine 20 to optimize the extraction or infusion of ingredients 16 disposed within steeping chamber 40. As described further below, once steeping chamber 40 is filled with fluid, the pressure within steeping chamber 40 will increase as the fluid continues to flow into steeping chamber 40 through injection system 22. The increase in pressure within steeping chamber 40 is believed to further enhance the process of extraction or infusion of ingredients 16 disposed within steeping chamber 40. Also, extracts from ingredients 16 such as aroma and taste compounds, lipid and functional compounds may act to reduce the surface tension of fluid to further permit flow through filter 14.

A steeping chamber 40 having a greater volume V1 will take a greater period of time in a machine 20 to fill with fluid before pressure builds up within steeping chamber 40. A steeping chamber 40 having a lesser volume V1 will conversely take a lesser period of time to fill with fluid and thus will build up pressure sooner and to a greater extent as fluid continues to flow into steeping chamber 40. It has been found that a lesser volume V1 is preferred for optimum performance of steeping chamber 40.

Ingredients 16 that are disposed in steeping chamber 40 may include insoluble ingredients 16 such as tea leaves, coffee grounds, herbs, spices or other ingredients adapted for forming a consumable product by extraction or infusion. Additional ingredients 16 may be disposed either in steeping chamber 40 or elsewhere in interior space 34. Such additional ingredients 16 may include soluble ingredients 16 such as coffee, chocolate, soup stock, flavor additives or other ingredients in powdered, crystallized or other forms adapted for solubility or contained within a soluble film or pouch. Additional ingredients 16 may also include active ingredients (eg foaming agents), natural health additives, regulated drugs, alcohol or other soluble or insoluble ingredients.

One or more ingredients 16 may include sensory attributes that are desirable to convey to a consumer or end user prior to the preparation of the consumable product. For example, ingredients 16 may include soluble or insoluble ingredients having visual attributes that may be of interest to a consumer. Examples of ingredients 16 with visual attributes include whole tea leaves, florets, pieces of dried fruit, vegetables, herbs, nuts or beans, pieces of chocolate, spices (such as cloves or cinnamon sticks), natural health additives (eg gogi berries), dried pieces of meat (eg shrimp), tofu, vegetables or noodles for soup.

In a preferred embodiment, ingredients 16 include a subset of ingredients having irregular shapes and/or relatively large particulate sizes such as one or more of whole leaf teas, herbs, spices, fruits and flowers. Preferably ingredients 16 include a combination of larger particulate sizes and smaller particulate sizes. Ingredients having larger particulate sizes may include whole or substantially whole leaves or other desired portions of tea, herbs, spices, fruits and flowers. Ingredients having smaller particulate sizes may include cut, ground, crystallized or otherwise processed portions of such ingredients. Preferably, at least 50% of the ingredients comprise ingredients having a particulate size greater than a #16 mesh (1.18 mm). More preferably, at least 70% of the ingredients comprise ingredients having a particulate size greater than a #16 mesh.

In one embodiment, for single serve capsules 10 having a volume up to 100 cc, a preferred consumable product having improved sensory attributes is formed from 1.5 grams to 30 grams of ingredients 16 comprising one or more of whole leaf teas, herbs, spices, fruits or flowers as described above in which at least 50% of ingredients 16 have a particle size of at least 1.18 mm (mesh #16).

In other embodiments, multiple filters 14 may be disposed within interior space 34 of capsule 10. Such filters 14 may be disposed inside or outside of steeping chamber 40. Additional filters 14 may have different average fluid flow rates as well as different degrees of phobicity or non-phobicity to fluid.

Figure 3:
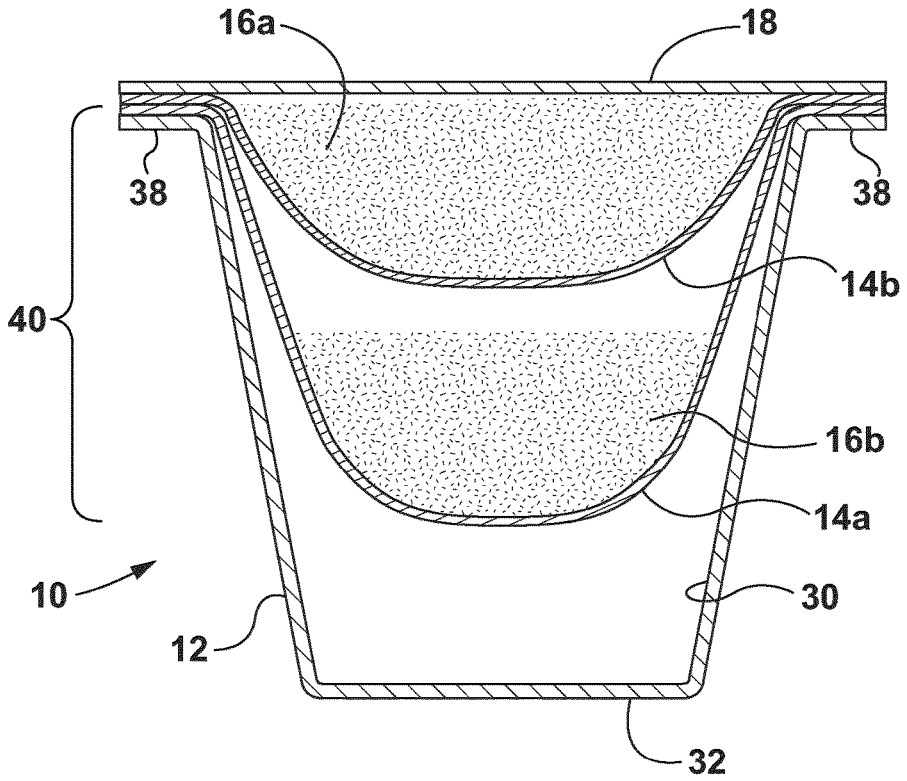
FIG. 3 is a sectional view of a capsule in accordance with another aspect of the present invention.

FIG. 3 for example depicts a capsule 10 in accordance with an alternate embodiment of the invention. The same figure references are used to identify similar features to the capsule 10 for the embodiment described above.

Capsule 10 includes a steeping chamber 40 defined between cover 18 and filter 14*a*. Filter 14*a* has fluid phobic properties similar to those described in the embodiment above. It may be seen that steeping chamber 40 has a greater volume V1 than the volume V1 for the embodiment of capsule 10 described above. This allows a longer dwell time before the conditions within steeping chamber 40 cause fluid to flow through filter 14*a*.

Capsule 10 further includes a second filter 14*b* disposed in steeping chamber 40 above filter 14*a*. Second filter 14*b* defines a first ingredients chamber 44 that is disposed proximate to a transparent cover 18. Ingredients chamber 44 is adapted to contain a subset of ingredients 16*a* that have visual attributes that may be viewed through transparent cover 18. Additional ingredients 16*b* are disposed in steeping chamber 40 outside of first ingredients chamber 44 (these may include additional insoluble ingredients 16 that may have less desirable visual attributes). Additional ingredients 16*c* may also be disposed in interior space 34 outside of steeping chamber 40 (these may include soluble or active ingredients 16).

Figure 4A:
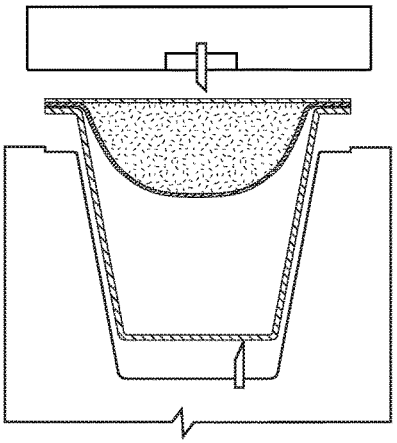
FIGS. 4A-4H are schematic sectional views of the capsule and machine of FIG. 1 during consecutive stages of the process for preparing a consumable product.
Figure 4B:
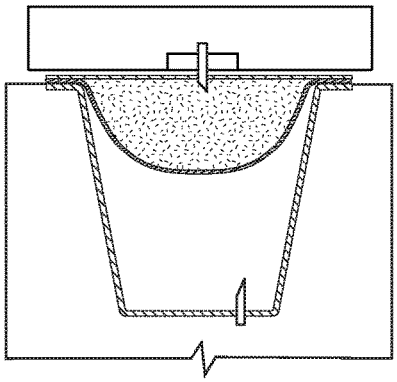
Figure 4C:
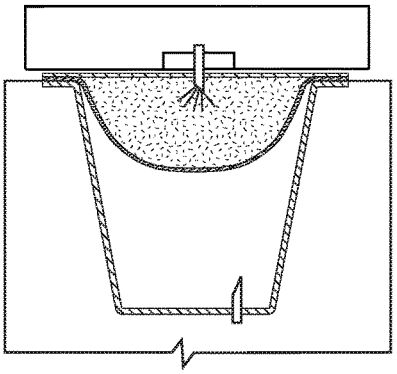
Figure 4D:
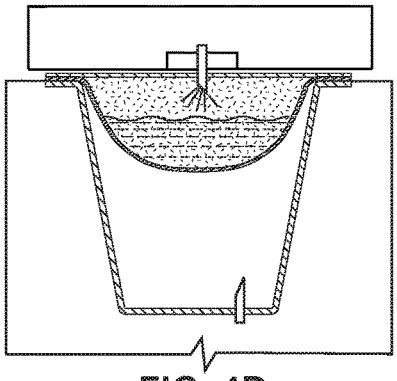
Figure 4E:
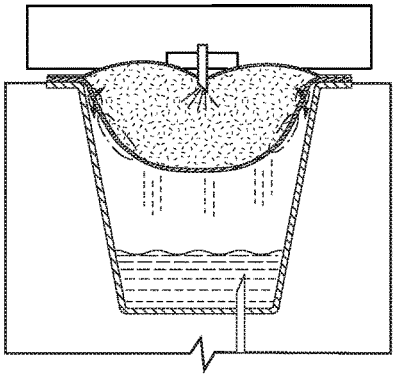
Figure 4F:
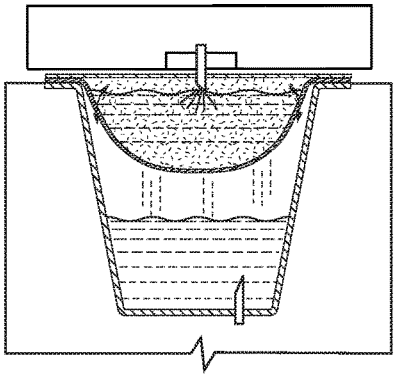
Figure 4G:
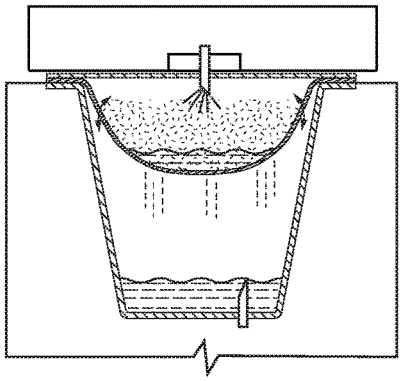
Figure 4H:
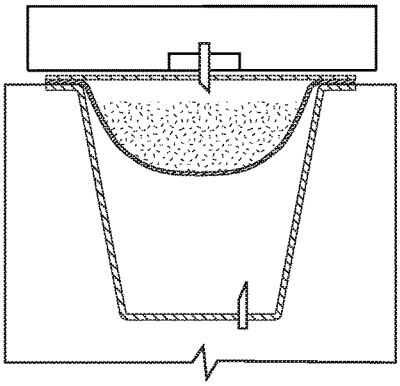

Referring to FIGS. 4A-4H, a capsule 10, in accordance with the first embodiment depicted in FIGS. 1 and 2, is shown during different stages of the process for preparing a consumable product from the capsule 10. FIG. 4A shows capsule 10 disposed in machine 20 prior to activation of the product preparation process. FIG. 4B shows an injection nozzle 22*a* for injection system 22 piercing cover 18 of capsule 10 and a dispensing nozzle 24*a* for dispensing system 24 piercing end wall 32 of capsule 10. FIG. 4C shows fluid (heated water) being injected into steeping chamber 40 of capsule 10. FIG. 4D shows fluid (heated water and extract from ingredients 16) collecting within steeping chamber 40 due to the phobic properties of filter 14. FIG. 4E shows steeping chamber 40 filled with fluid (heated water and extract from ingredients 16) and fluid (heated water and extract from ingredients 16) passing through filter 14 of capsule 10 for dispensing through dispensing system 24. It can be seen in FIG. 4E that cover 18 bulges upwardly away from steeping chamber 40 due to the higher pressure within steeping chamber 40 as fluid continues to enter steeping chamber 40 at a higher rate than fluid exits through filter 14. FIG. 4F shows the fluid level within steeping chamber 40 dropping as the flow rate of fluid entering steeping chamber 40 through injection system 22 subsides. FIG. 4G shows the fluid level within steeping chamber 40 continuing to drop as a blast of air is injected into steeping chamber 40 through injection system 22 to complete the product preparation process. FIG. 4H shows capsule 10 following completion of the product preparation process with little or no fluid remaining in capsule 10 and fully saturated ingredients 16 disposed in steeping chamber 40.

While the above description provides examples of one or more processes or apparatuses, it will be appreciated that other processes or apparatuses may be within the scope of the accompanying claims.

We claim:

1. A capsule, for use in a machine for preparing consumable products from capsules, said machine having an injection system that includes at least one injection nozzle for injecting heated fluid into said capsule at a predetermined flow rate, said capsule comprising:

a body defining an interior space with an opening;

a cover disposed over said opening, said cover being formed of a material that is heat shrinkable and resistant to tearing so as to shrink sufficiently around said at least one injection nozzle when said at least one injection nozzle pierces said cover and injects heated fluid into said capsule, to create a seal that allows pressure to build within said interior space beneath said cover up to a maximum pressure;

a filter disposed in said interior space to define a steeping chamber between said filter and said cover, said filter being formed of one or more materials that are sufficiently phobic to said heated fluid to cause said steeping chamber to fill with fluid without exceeding said maximum pressure; and ingredients disposed in said steeping chamber for preparing a desired product, wherein said filter is constructed and arranged to restrict a flow of the fluid through said filter to optimize extraction or infusion of said ingredients disposed within said steeping chamber.

2. The capsule of claim 1, wherein said filter has an average fluid flow rate that is in the range of 50% to 90% of the average fluid flow rate for fluid being injected into said capsule.

3. The capsule of claim 1 wherein said filter has an average fluid flow rate that is in the range of 60% to 80% of the average fluid flow rate for fluid being injected into said capsule.

4. The capsule of claim 1 wherein said steeping chamber has a volume that is at least 90% filled by said ingredients.

5. The capsule claim 1 wherein at least 50% of said ingredients disposed in said steeping chamber have a particulate size greater than a #16 mesh.

6. The capsule of claim 1 wherein said ingredients are selected from tea, herbs, spices, fruits and flowers.

7. The capsule of claim 1 wherein said cover has a minimum tensile strength of 3000 psi.

8. The capsule of claim 1 wherein said cover has a minimum elongation of 50%.

9. The capsule of claim 1 wherein said ingredients may be viewed through said cover prior to use of said capsule in said machine.

10. The capsule of claim 1 wherein said filter includes one or more high flow zones that allow a higher rate of fluid flow compared to the remainder of said filter.

11. The capsule of claim 1 wherein said filter includes one or more high flow zones at a location on said filter proximate to said cover.

12. The capsule of claim 1 wherein said filter includes one or more low flow zones that allow a lower rate of fluid flow compared to the remainder of said filter.

13. The capsule of claim 1 wherein said filter includes one or more low flow zones disposed along the sides of said filter to reduce the fluid flow along said sides.

14. The capsule of claim 1 further comprising a second filter disposed in said steeping chamber.

15. The capsule of claim 14 wherein said second filter defines a first ingredients chamber that is adapted to contain a subset of said ingredients.

16. The capsule of claim 15 wherein said cover is transparent and wherein said first ingredients chamber is disposed proximate to said transparent cover.

* * * * *